US011118853B2

(12) United States Patent
Markut

(10) Patent No.: US 11,118,853 B2
(45) Date of Patent: Sep. 14, 2021

(54) GAS-OPERATED FIREARM WITH ADJUSTABLE GAS PRESSURE SELECTOR

(71) Applicant: GLOCK TECHNOLOGY GMBH, Ferlach (AT)

(72) Inventor: Karl Markut, Klagenfurt (AT)

(73) Assignee: GLOCK TECHNOLOGY GMBH

( * ) Notice: Subject to any disclaimer, the term of this patent is extended or adjusted under 35 U.S.C. 154(b) by 0 days.

(21) Appl. No.: 17/061,784

(22) Filed: Oct. 2, 2020

(65) Prior Publication Data

US 2021/0222975 A1 Jul. 22, 2021

(30) Foreign Application Priority Data

Oct. 4, 2019 (EP) ..... 19201447

(51) Int. Cl.
*F41A 5/28* (2006.01)
*F41A 5/24* (2006.01)

(52) U.S. Cl.
CPC . *F41A 5/28* (2013.01); *F41A 5/24* (2013.01)

(58) Field of Classification Search
CPC ..... F41A 5/26; F41A 5/28
See application file for complete search history.

(56) References Cited

U.S. PATENT DOCUMENTS 8,596,185 B1 * 12/2013 Soong ..... F41A 5/28 89/193
8,960,069 B1 2/2015 Soong
9,335,106 B1 * 5/2016 Simon ..... F41A 5/28
9,372,038 B1 6/2016 Sylvester
2006/0065112 A1 3/2006 Kuczynko
2012/0167756 A1 * 7/2012 Larue ..... F41A 21/28 89/193
2015/0292825 A1 10/2015 Cassels
2016/0033218 A1 2/2016 Folkestad, II
2017/0307315 A1 10/2017 Mcgloin
2017/0321978 A1 11/2017 Brannan
2018/0202733 A1 * 7/2018 Bray ..... F41A 5/28
2021/0055067 A1 * 2/2021 Nguyen ..... F41A 5/28

FOREIGN PATENT DOCUMENTS

WO 2016086191 A2 6/2016

OTHER PUBLICATIONS

Search Report for related EP application No. 19201447.0-1011 dated Mar. 12, 2020.

* cited by examiner

*Primary Examiner* — Gabriel J. Klein
(74) *Attorney, Agent, or Firm* — Raven Patents, LLC

(57) ABSTRACT

Gas-operated firearms, in which the gas system guides gas selectively from the gas removal bore to a gas pipe, with a platelet, movable between at least two positions in the gas system. The platelet may be pivotable about a pivot axis pin. A stop pin, parallel to the pivot axis pin, may protrude into a stop bore of the platelet, thus delimiting the pivoting. The platelet may have at least two recessed catch positions, into which a catch, under the effect of a catch spring, optionally engages, provided that the gas through-bore associated with the catch comes to rest in alignment between the gas bores when the catch engages in one of the recesses.

13 Claims, 4 Drawing Sheets

Fig.3
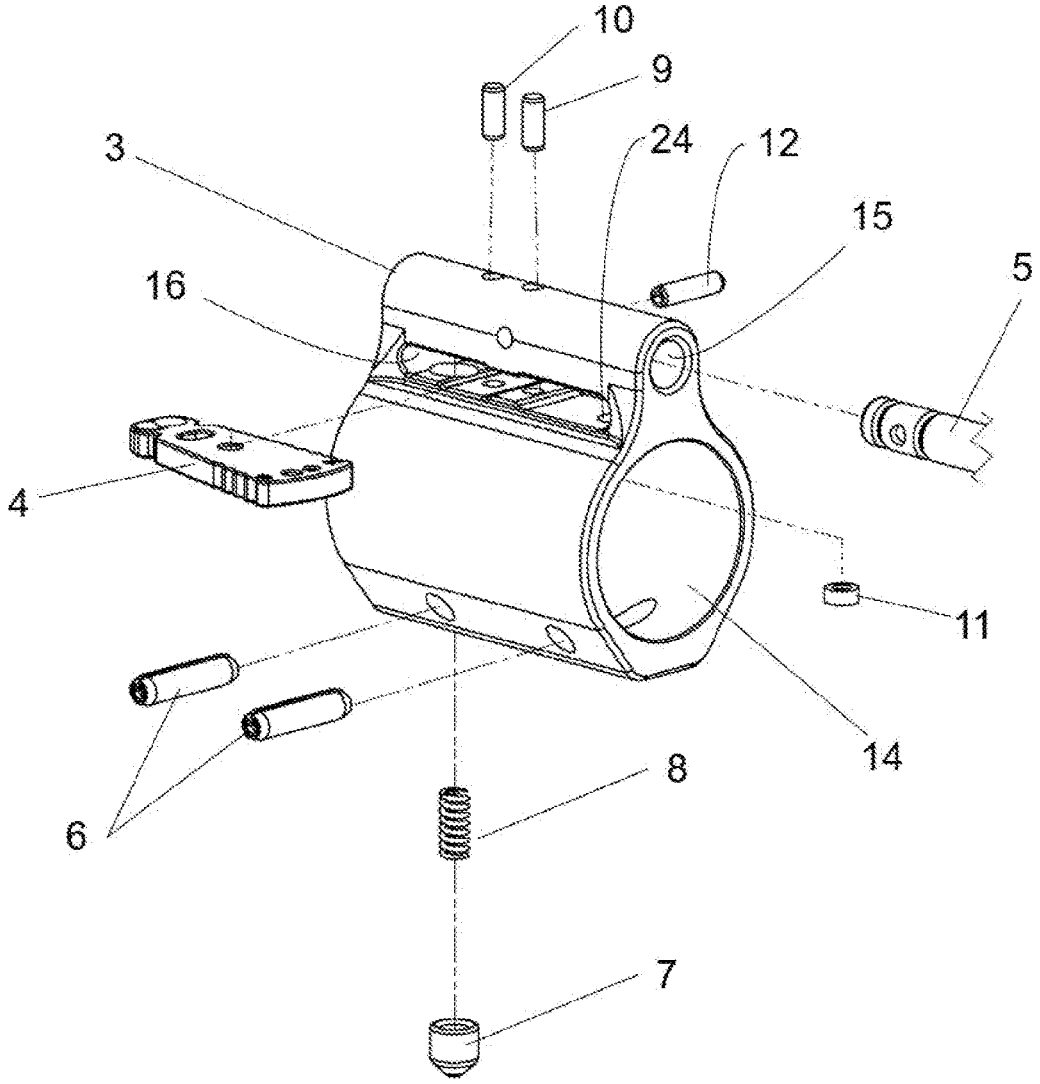
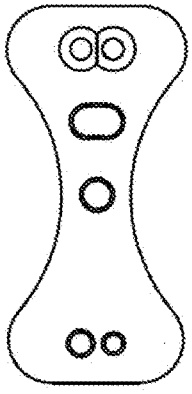
Fig.4A
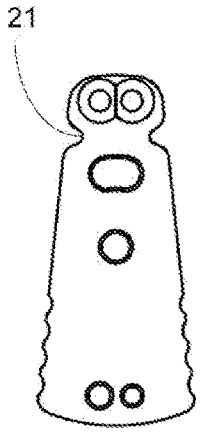
Fig.4B
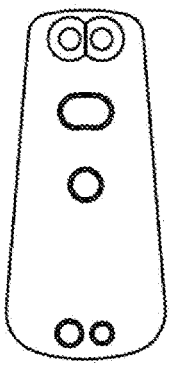
Fig.4C
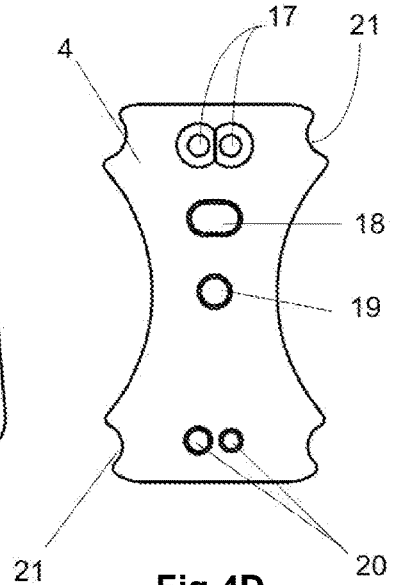
Fig.4D Fig.5
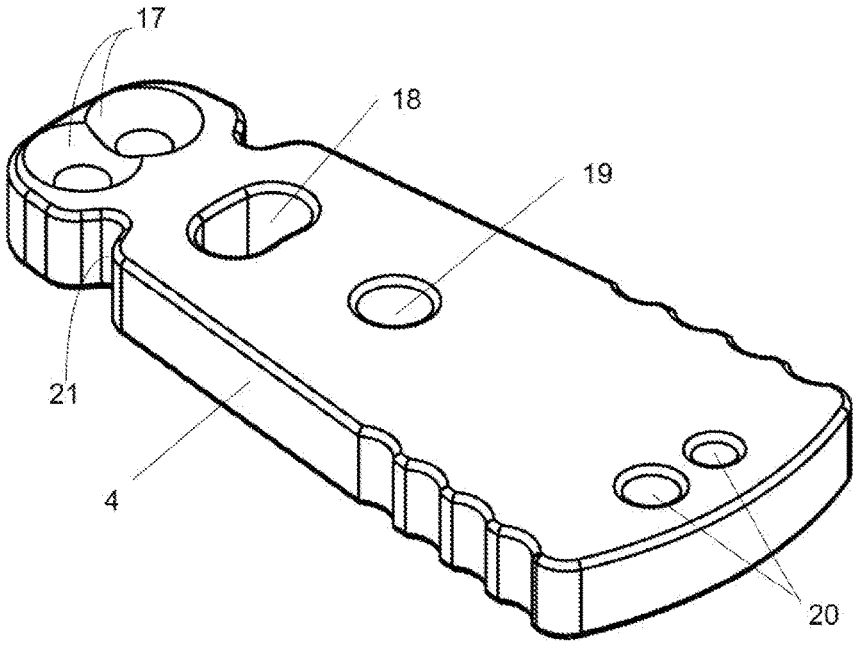
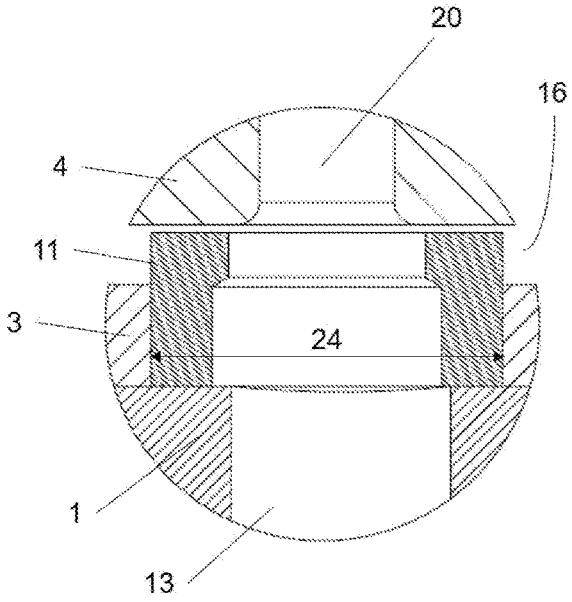
Fig.7A
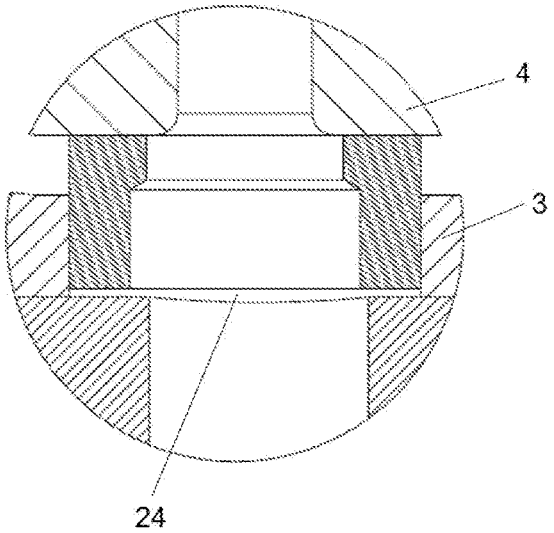
Fig.7B

GAS-OPERATED FIREARM WITH ADJUSTABLE GAS PRESSURE SELECTOR

TECHNICAL FIELD

The present disclosure is directed to firearms having gas-operated loading systems, and more particularly to gas-operated rifles that include an adjustable gas pressure selector.

BACKGROUND

Many automatic firearms, such as the M4- or AR15-based systems, feature a reloading process that is gas-powered. Upon firing, a small portion of the expanding gas used to propel the projectile from the barrel is diverted by means of at least one gas removal bore located in the vicinity of the muzzle, and guided via a gas block and a gas pipe in the direction of the breech block. The high energy of the gas pressure is used to unlock and open the breechblock and to eject the empty casing.

Using different types of ammunition can result in different gas pressure, which in turn varies the pressure of the gas diverted and delivered to the reloading mechanism. By permitting the pressure of the diverted gas to be adjusted as needed, the reloading mechanism can continue to operate properly. The gas pressure can be adjusted by any method of controlling or adjusting the gas pressure, sometimes referred to as a gas pressure selector. A variety of methods of adjusting the gas pressure in gas-operated firearms have been previously employed.

One very widespread type of gas pressure selector includes rotatable or screwable gas pressure selectors that are arranged, for example at the gas block or also near the breech at the so-called "gas key." For example, the gas pressure selector can be configured so that rotation of the gas pressure selector places differently-sized bores between the gas removal bore and the gas pipe. By selecting the diameter of bore used, the gas pressure selector can regulate the gas flow to the reloading mechanism. In some cases, a selection of "no hole" can completely interrupt the gas flow, which blocks the ability of the weapon to reload automatically. See, for example, US2015292825A1, or U.S. Pat. No. 9,372,038 B1 (hereby incorporated by reference).

Published application US2017321978 A1 (hereby incorporated by reference) discloses a screwable gas pressure selector incorporating differently sized bores in the threaded portion of the selector, permitting regulation of the gas flow.

Published application US2016033218A1 (hereby incorporated by reference) discloses a gas pressure selector that is adjustable by means of a tool, such as a screwdriver.

Variations of gas pressure selectors located at the so-called "gas key" are disadvantageous for use in the field, because the gas flow of the weapon is only adjustable when the weapon is disassembled.

In addition, gas pressure selectors can frequently only be adjustable by means of a tool, such as a screwdriver. Such solutions are also disadvantageous for field use, as without the appropriate tool, gas pressure cannot be adjusted.

Variations of gas pressure selectors that include valves have also been described. For example international publication WO2016/086191A2 (hereby incorporated by reference) discloses a gas pressure selector that employs a needle valve for adjusting the gas flow.

Previous solutions in which gas pressure selectors are mounted by means of threaded fasteners are typically unfeasible, as the elaborate and expensive production of threads require increased production costs, and preclude a low production cost.

Those variations of gas pressure selectors that do not employ integrated catches or stops create the possibility of an inadvertent adjustment of the gas pressure selector to "zero flow," disabling automatic reloading, and therefore rendering the weapon unusable in the field.

Gas pressure selectors that employ slider variations fail to provide an automatic seal, and so the diverted gas flow can escape in an undesired and uncontrolled manner.

Published US application US201615133633A1 discloses a slidable gas pressure selector without an end stop, while published application US20060065112A1 also discloses a slidable gas pressure selector with a catch but without an end stop (each publication hereby incorporated by reference).

Issued U.S. Pat. No. 8,960,069B1 describes a slidable gas pressure selector including a platelet that is slidable transversely to the barrel axis and has two bores which can be alternately aligned with the removal bore in the barrel. A pin, arranged parallel to the barrel axis in the plane of the platelet and pushed by a spring towards the platelet, engages in recesses at the edge of the platelet, thus safely ensuring the position of the platelet without preventing the desired sliding. The sliding, as with any sliding without a specific guide, is always threatened by tilting, which greatly impairs the functionality. Notwithstanding the above, the device leaks above and below the platelet with all the associated disadvantages.

There exists a need for a gas system with a gas pressure selector that does not have the disadvantages of the various prior art gas systems, but includes a gas pressure selector that is reliable, easy to clean, and easily and reliably adaptable, and that in some embodiments can also be sealed to the greatest possible extent.

SUMMARY

The present disclosure relates to a firearm having a barrel with a gas removal bore 13 and a gas system, which guides gas selectively from the gas removal bore 13 through a lower gas bore 24 and a matchingly aligned upper gas bore 23 to a gas pipe 5, with a platelet 4, movable between at least two positions in the gas system, in which at least two gas through-bores 20 of different cross-sections are provided, with a catch element 7 which is under the effect of a spring 8 and ensures the selected position of the platelet 4, wherein, in each of the at least two positions of the platelet 4, one of the at least two gas through-bores 20 comes to rest in alignment between the gas bores 23, 24, characterized in that the platelet 4 is pivotable about a pivot axis pin 9, immovably provided in the gas system, the axis of which runs parallel to the axis of the bores 23, 24 and is pivotable; that a stop pin 10, immovably provided in the gas system and parallel to the pivot axis pin 9, protrudes into a stop bore 18 of the platelet 4, thus delimiting the pivoting; that the platelet 4 has at least two recessed catch positions 17, into which a catch 7, under the effect of a catch spring 8, optionally engages, provided that the gas through-bore 20 associated with the catch 7 comes to rest in alignment between the gas bores 23, 24 when the catch 7 engages in one of the recesses.

BRIEF DESCRIPTION OF THE DRAWINGS

The presently disclosed firearms shall be explained in greater detail with reference to the drawings and selected disclosed embodiments.

FIG. 3 shows an exploded view of an illustrative gas block of the present disclosure, including individual gas block components.

FIGS. 4A-4D depict selected variations of the disclosed gas pressure selector.

FIG. 5 is a three-dimensional view of a selected variation of the disclosed gas pressure selector.

FIGS. 7A and 7B show detailed views of a sealing sleeve in a gas block of the illustrative gas block.

DETAILED DESCRIPTION

The problems that have characterized previous gas systems can be solved by a gas system of the present disclosure, which can demonstrate one or more of the following advantages:

- The gas system has a gas pressure selector, which is pivotable about an axis and multi-adjustable, for the tool-free adjustment of the gas pressure forwarded from the barrel in the direction of the gas pipe;
- the pivotable gas pressure selector has a locking system, with which at least two predetermined positions of the gas pressure selector are to be selected, wherein no undefined intermediate position can be set;
- the pivotable gas pressure selector has an end stop and can thus not assume a "too far" position;
- the respective selectable position of the gas pressure selector corresponds to a respective associated gas through-bore with a correspondingly designed diameter in order to adjust the gas flow.

Figure 1:
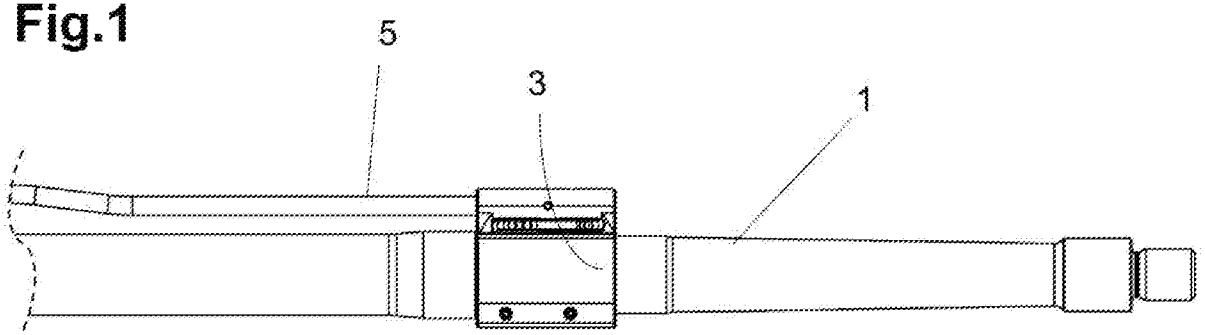
FIG. 1 shows a barrel of a rifle equipped with an illustrative gas block according to the present disclosure.
Figure 2:
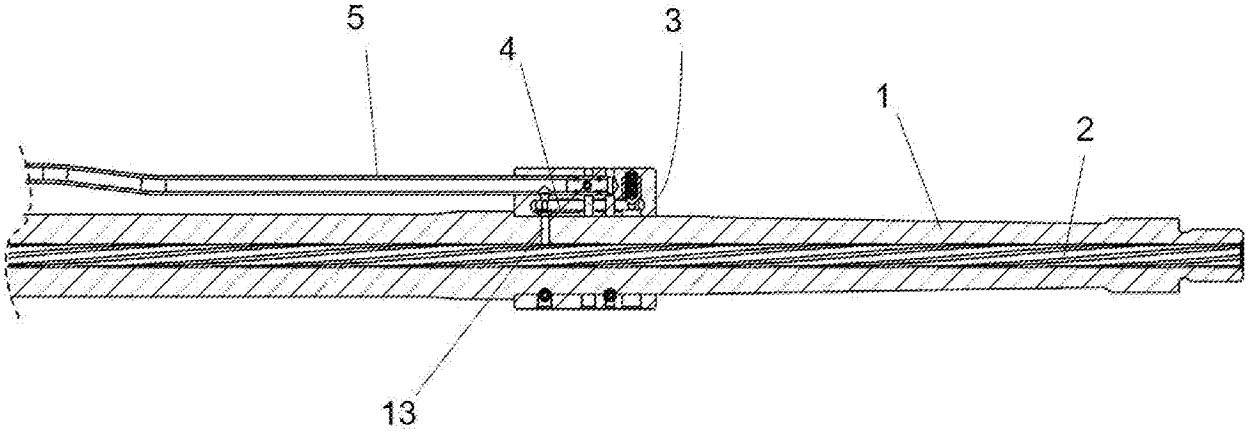
FIG. 2 shows a vertical cross-section of the barrel and gas block of FIG. 1.

FIG. 1 shows a typical firearm barrel 1 with the gas block 3 mounted near the muzzle, and a gas pipe 5 of a gas-operated weapon. FIG. 2 shows a cross-section of the barrel axis of a typical barrel 1 with barrel bore 2 and gas removal bore 13, via which a gas flow from the barrel 1 into the gas block 3 and further into the gas pipe 5 is possible.

The gas block 3, shown in an exploded view in FIG. 3, has a barrel seat 14 for the barrel 1 and a gas pipe seat 15 for the gas pipe 5. By means of a retaining device 6, consisting of two pins in the depicted embodiment, the gas block 3 is fastened to the barrel 1, and to the gas pipe 5 by means of a gas pipe holding pin 12.

The gas pressure selector 4 fits into the gas block recess 16 provided for this purpose and is pivotably mounted in the gas block by means of a pivot axis pin 9, wherein the pivoting movement is delimited by a stop pin 10. A catch element 7 with a catch spring 8 effects an automatic meshing of the gas pressure selector 4 at one of the at least two predetermined options of the pivoting movement. Optionally, a sealing sleeve 11 lying in a lower gas bore 24 is provided, which shall be explained in more detail below.

The gas pressure selector can be actuated without tools and with one hand on both sides. It can have one or more improved haptic surface structurings 21 to allow for an adjustment without slippage, for example, using a cartridge as a "tool." The improved haptic surface structuring 21 is shown as an anti-slip notch, in which, for example, the projectile side of a cartridge engages. This is advantageous particularly when used in the field in adverse weather conditions (e.g., cold, wet) and when using gloves.

By way of example, FIG. 4 shows a top view of corresponding different, possible shapes of the gas pressure selector 4 with two adjustment options each; the option for providing one or more notches 21 as well as the indentations 17, which interact with the catch element 7, can be clearly seen. As can be clearly seen, the recesses 17 merge, which indicates that no flat surface is formed normally to the movement direction of the catch 7, and the catch 7 is thus always pushed into one of the recesses 17 by the catch spring 8, so that it is reliably prevented that the gas pressure selector 4 is brought into an inactive intermediate position. If this should take place, the catch 7, due to the effect of the catch spring 8, will push the gas pressure selector 4 into one of the two possible "correct" positions.

The two gas through-bores 20 with different diameters can be clearly seen in FIG. 4, as well as the axial bore 19, with which the gas pressure selector 4 rotates about the pivot axis pin 9, and the stop bore 18, actually a curved elongated hole which, through interaction with the stop pin 10, delimits the pivoting movement of the gas pressure selector 4 about the pivot axis pin 9.

FIG. 5 shows a perspective view of a possible shape of the gas pressure selector. It can be clearly seen that, due to the approximately central position of the rotational axis—the axial bore 19 between the front and the rear end of the selector 4—a pushing actuation is possible even if the end of the selector with the gas through-bores 20 is pushed into the gas block 3 all the way to the stop, and so a gripping and (one-handed) pressing from the other side of the weapon is possible, but not necessary.

The functional principle of the disclosed firearms can be summarized as follows:

In the initial state, a cartridge is located in the cartridge chamber (not depicted) of the barrel 1. After firing a shot, the projectile, driven by the gas pressure of the propellant charge, moves in the barrel bore 2 in the direction of the muzzle. After the projectile has passed the gas removal bore 13, shown in FIG. 6, a portion of the combustion gases, generated by the combustion process of the propellant charge, flows through the gas removal bore 13 into the corresponding lower gas bore 24 (FIG. 3) of the gas block 3 with the sealing sleeve 11, through the gas through-bore 20 of the gas pressure selector 4, through the upper gas bore 23 of the gas block 3 and continues through the gas pipe bore 22 into the interior of the gas pipe 5.

Figure 6:
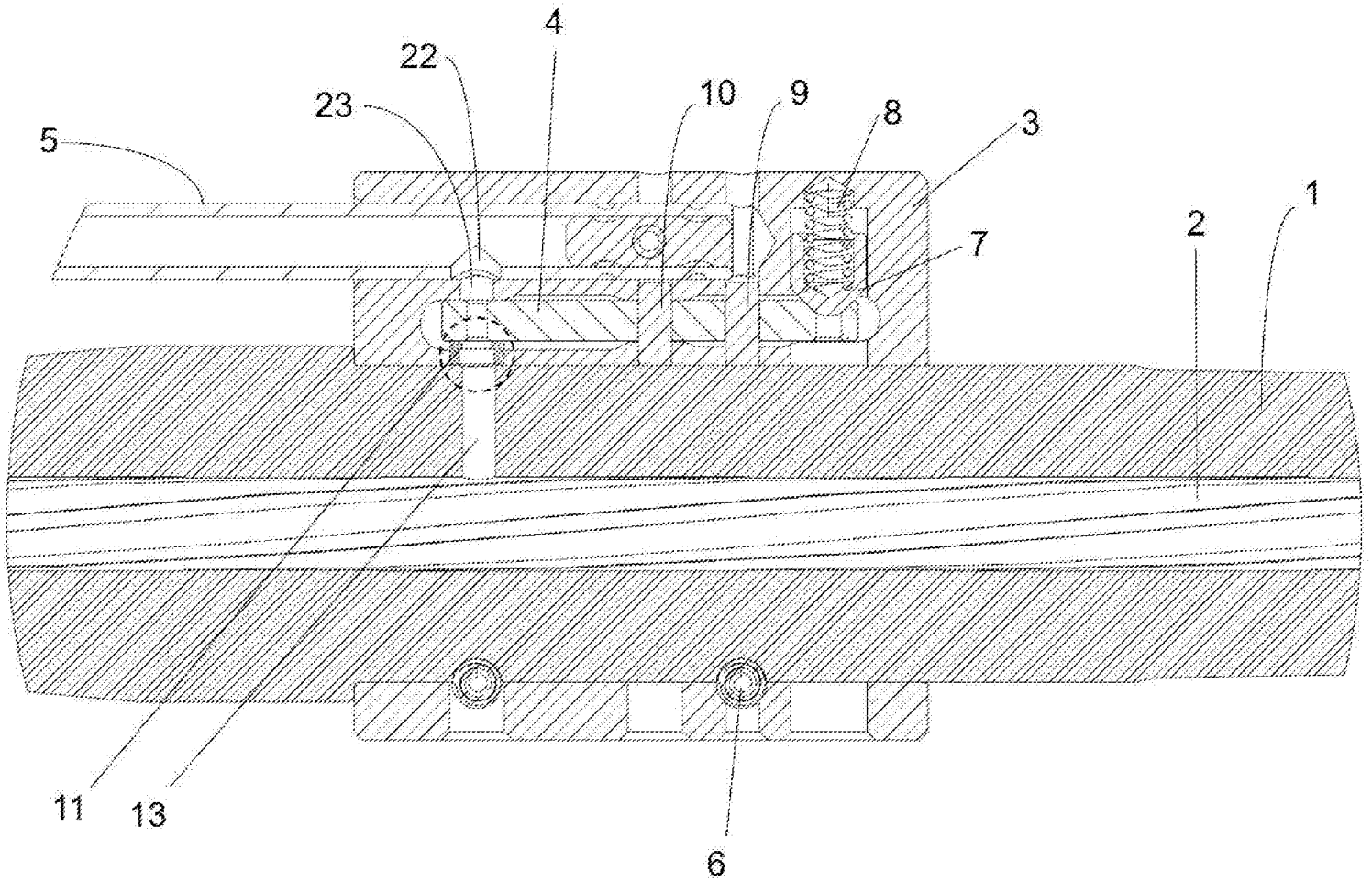
FIG. 6 shows a vertical cross-section of an illustrative gas block according to the present disclosure.

FIG. 6 shows the entire structure of an adjustment device according to the disclosure as a sectional view through the weapon median plane: From the barrel 1, the gas removal hole 13 branches off and opens into the gas block 3 in a lower gas bore 24 (FIG. 3). In said gas bore, a sealing sleeve 11 is inserted, the operating principle of which shall be explained below with reference to FIG. 7. One of the gas through-bores of the selector 4, also simply called a platelet, is arranged in alignment with the lower gas bore; the upper gas bore 23, which opens into the gas bore 22 of the gas pipe 5, is arranged above. Said platelet is inserted with its front end deep into a seat of the selector 4 and secured by a gas pipe retaining pin 12 running normally to the weapon median plane. In order to avoid undesired gas leakage toward the front, the gas pipe 5 is closed in this area by means of a plug which also contributes to the mechanical robustness in the area of the pin 12.

In the front area of the gas block 3, a recess, preferably a bore, is provided which runs normally to the barrel 1 in the weapon median plane, and in which the catch element 7 is slidably mounted and pushed under the effect of a catch spring 8 toward the selector 4. The tip of the catch element is preferably designed to be conical, with a rounded tip, in order to be able to interact in the best possible manner with the recesses of the catch positions 17. The pivot pin 9 and the stop pin 10 are mounted in two through-bores, which, in the depicted embodiment, are held in this manner, on the side of the recess which is at a distance from the barrel and on the side close to the barrel, in the gas block 3 for the selector 4, which is particularly advantageous in case of the dynamic load.

The gas block 3 as a whole is attached to the barrel with a retaining device 6; by way of example, the drawing shows two holding pins which lie in recesses of the gas block and corresponding transverse grooves of the barrel.

In the gas block 3, as can also be clearly seen in FIG. 6, the different bores are parallel to one another and can thus be produced without reclamping; in addition, with the exception of the seat for the catch 7, they are designed as through-bores, which is also advantageous for the production. It is also possible to design said bores as stepped through-bores, but this requires the use of a spring plate. The incrementing of the diameters of the bores 23, 24, as described below, can also be produced without problems.

The gas flow from the barrel 1 into the gas pipe 5 via the gas block 3 is regulated by selecting differently sized diameters of the at least two gas through-bores 20 of the gas pressure selector 4. A small diameter causes a lower gas flow (e.g., for cartridges with a larger propellant charge) and correspondingly, a larger diameter causes a larger gas flow (e.g., for use of cartridges with a smaller propellant charge). The gas pressure selector is centrally provided with an axis bore 19; in the installed state, the gas pressure selector 4 is correspondingly pivotable about the pivot axis pin 9 located in the axis bore 19. The stop recess 18 and the stop pin 10 lying therein form an internal end stop and delimit the possible pivoting movement. According to the number of gas through-bores 20, there are at least two catch positions 17 which, in the installed state, each individually align the respective associated gas through-bore 20 in one line with the gas removal bore 13 of the lower gas bore 24 and the upper gas bore 23, thus allowing for the gas flow through the respective gas through-bore 20 with the appropriate diameter.

FIGS. 7A and 7B show the circled detail of FIG. 6, the optionally provided sealing sleeve 11, which lies in the lower gas bore 24, in its installation situation (FIG. 7A) and in the operating state (FIG. 7B), while gas flows through it. FIG. 7B shows how, due to the sudden pressure increase, the sealing sleeve is carried along by the gas flow, effecting a sealing of the gap between the gas block 3 and the gas pressure selector 4.

Toward the top, the gas pressure selector 4 is already sealed off with regard to the gas block 3 because the installation takes place without gaps.

The inner diameter of the sealing sleeve 11 is at least as large as the diameter of the gas removal bore and tapers toward the top. The tapered inner diameter of the sealing sleeve 11 is greater than the diameter of the largest gas through-bore 20 of the gas pressure selector 4. The "large" diameter of the sealing sleeve 11 is smaller than or equal to the diameter of the lower gas bore 24.

Due to these measures, the sealing sleeve 11 is lifted up, as shown in FIG. 7B, when gas flows from the barrel 1 to the gas pipe 5, closing the gap to the gas pressure selector 4; however, the sealing with regard to the gas block 3 is maintained due to the contact of the jacket of the sealing sleeve with the wall of the lower gas bore 24. Mini gaps occurring in rare cases in the course of unfavorable tolerance accumulations between the gas pressure selector 4 and the upper gas bore 23 are also closed by these measures.

For the assembly, it shall only be described briefly, with reference to FIG. 6, that the catch spring 8, together with the catch 7, is introduced first into its seat, followed by the insertion of the selector 4 into the slot of the gas block 3, wherein the sealing sleeve 11 is optionally inserted beforehand in the lower gas bore 24, followed by the insertion of the pins 9, 10 which thus hold the selector. The gas block is subsequently pushed onto the barrel, the gas pipe 5 is appropriately threaded, and the pins 6 and 12 are used for the final fastening. By means of an appropriately selected fit, it can be ensured that the pins 9, 10 are not lost during handling; attention must be paid to the correct installation of the sealing sleeve 11.

Aspects and Features

The following numbered paragraphs describe selected additional aspects and features of the gas-operated firearms of the present disclosure. Each of these paragraphs can be combined with one or more other paragraphs, and/or with disclosure from elsewhere in this application, including materials incorporated by reference, in any suitable manner. Some of the paragraphs below expressly refer to and further limit other paragraphs, providing without limitation examples of some of the suitable combinations.

A1. A firearm having a barrel with a gas removal bore (13) and a gas system, which guides gas selectively from the gas removal bore (13) through a lower gas bore (24) and a matchingly aligned upper gas bore (23) to a gas pipe (5), with a platelet (4), movable between at least two positions in the gas system, in which at least two gas through-bores (20) of different cross-sections are provided, with a catch element (7) which is under the effect of a spring (8) and ensures the selected position of the platelet (4), wherein, in each of the at least two positions of the platelet (4), one of the at least two gas through-bores (20) comes to rest in alignment between the gas bores (23, 24), characterized in that the platelet (4) is pivotable about a pivot axis pin (9), immovably provided in the gas system, the axis of which runs parallel to the axis of the bores (23, 24) and is pivotable; that a stop pin (10), immovably provided in the gas system and parallel to the pivot axis pin (9), protrudes into a stop bore (18) of the platelet (4), thus delimiting the pivoting; that the platelet (4) has at least two recessed catch positions (17), into which a catch (7), under the effect of a catch spring (8), optionally engages, provided that the gas through-bore (20) associated with the catch (7) comes to rest in alignment between the gas bores (23, 24) when the catch (7) engages in one of the recesses.

A2. The firearm according to paragraph A1, characterized in that adjacent recessed catch positions (17) merge into one another.

A3. The firearm according to paragraph A1 or A2, characterized in that the platelet (4) is provided on its outline with at least one anti-slip notch (21).

A4. The firearm according to paragraph A3, characterized in that the at least one anti-slip notch (21) corresponds geometrically to the projectile side of a cartridge designed for the firearm.

Advantages

Firearms that are manufactured according to the present disclosure can demonstrate one or more of the following advantages:

Due to the inventive pivoting mechanism of the gas pressure selector with its simple structure, a gas system required a small number of parts is achieved. In addition, as those parts do not require threading, they can be more cost-effectively produced.

Furthermore, due to the pivotable arrangement of the gas pressure selector, the adjustment of the gas pressure on both sides with one hand (one-handed operation) is made possible without the aid of tools in a quick and simple manner.

In one embodiment, a special shape of the gas pressure selector with improved haptic surface structure allows for the adjustment of the gas pressure, e.g., in the field in bad weather conditions (cold, wet) and when wearing gloves, for example, with the aid of a cartridge. The improved haptic surface structure acts in a slip-proof manner and can, for example, have the shape of one or more indentations.

Another aspect of the disclosure relates to the sealing of the gas system. According to the disclosure, the gas system can be sealed against unwanted gas loss to the outside by means of a self-sealing sealing sleeve, and according to the disclosure, the full utilization of the gas pressure is accordingly possible without uncontrolled escape of gas on the side.

The disclosure is not limited to the depicted and described embodiments, but can be modified and developed in multiple ways. For example, particularly three or more gas through-bores 20 with different diameters can be provided, the notches 21 can have a different shapes and quantities, on its "underside," the gas pressure selector 4 can also have recesses 17 for the catch 7 to allow the user to be able to make the changes in the direction familiar to such user, and so forth.

In the description, as in the prior art, reference is made to the different diameters of the gas through-bores 20; in reality, the different cross-sections of these bores are important.

All materials already used in the prior art can be taken into consideration as the materials for the gas pressure selector, the pins, and the spring; a person skilled in the art can select them with the knowledge of the expected stress.

The barrel axis and the axis of the gas pipe are usually located in the weapon median plane which, for example, corresponds to the drawing plane in FIG. 6. This is due to the usual structure of a firearm or rifle, but it is not important for the structure of the selector according to the disclosure.

The terms "front," "back," "above," "below" and so on in the common form and with reference to an item in its normal position of use are used in the description and the claims. This means that, in a firearm, the muzzle of the barrel is thus "in front," that the lock and/or slide is moved to the "rear" by expanding gases, that the magazine, if present, points "downward," that the outlet device lies "under" the barrel, and the projectile flies "forwards," etc.

The present disclosure may be applied to any automatic or semi-automatic firearm, but is most applicable to long guns, such as rifles, carbines, and shotguns.

| List of Reference Numerals | |
|---|---|
| 1 | Barrel |
| 2 | Barrel bore |
| 3 | Gas block |
| 4 | Gas pressure selector, platelet |
| 5 | Gas pipe |
| 6 | Retaining device |
| 7 | Catch element (for gas pressure selector) |
| 8 | Catch element spring |
| 9 | Pivot axis pin |

-continued

| List of Reference Numerals | |
|---|---|
| 10 | Stop pin |
| 11 | Sealing sleeve |
| 12 | Gas pipe holding pin |
| 13 | Gas removal bore |
| 14 | Barrel seat |
| 15 | Gas pipe seat |
| 16 | Recess |
| 17 | Catch position |
| 18 | Stop bore |
| 19 | Axis bore |
| 20 | Gas through-bore |
| 21 | Anti-slip notch |
| 22 | Gas pipe bore |
| 23 | Upper gas bore |
| 24 | Lower gas bore |

What is claimed is:

1. A gas-operated firearm, comprising:

a barrel, the barrel defining a gas removal bore; and a gas diversion system configured to guide a gas selectively from the gas removal bore to a gas pipe that, in turn, delivers the gas to a gas-operated reloading mechanism of the firearm; wherein the gas diversion system includes:

a lower gas bore fluidly coupled to the gas removal bore, and an upper gas bore fluidly coupled to the gas pipe, such that the lower gas bore and the upper gas bore are disposed in alignment, and the lower gas bore and the upper gas bore are separated by a movable platelet;

a pivot axis pin that is fixed within the gas diversion system around which the movable platelet is pivotable, where an axis of the pivot axis pin is parallel to an axis of the upper gas bore and the lower gas bore;

a stop pin that is fixed within the gas diversion system and is parallel to the axis of the pivot axis pin, the stop pin protruding into a stop bore defined in the movable platelet such that interaction between the stop pin and a wall of the stop bore limits pivotable movement of the movable platelet; and a catch, urged by an associated catch spring, configured to engage one of at least two recessed catch positions defined in the movable platelet, wherein when the catch is engaged in one of the at least two recessed catch positions, the lower gas bore and the upper gas bore are disposed in alignment with one of at least two gas through-bores defined in the movable platelet, each gas through-bore corresponding to one of the at least two recessed catch positions; and each gas through-bore having a different cross-section;

such that by selectively moving the movable platelet between at least two positions in the gas diversion system, the gas being guided by the gas diversion system passes from the lower gas bore to the upper gas bore through the gas through-bore having a desired cross-section.

2. The firearm according to claim 1, wherein any two adjacent recessed catch positions merge into one another.

3. The firearm according to claim 1, wherein the movable platelet has a defined outline, and the outline defines at least one anti-slip notch.

4. The firearm according to claim 3, wherein the at least one defined anti-slip notch corresponds geometrically to a projectile side of a cartridge designed for the firearm.

5. The firearm according to claim 1, wherein the movable platelet is disposed substantially horizontally in the gas diversion system.

6. The firearm according to claim 5, wherein the pivotable movement of the movable platelet occurs in a horizontal plane.

7. The firearm according to claim 1, wherein the firearm is an automatic or semi-automatic long gun.

8. The firearm according to claim 1, wherein the firearm is an automatic or semi-automatic rifle.

9. A gas diversion system, comprising:

a gas diversion system body that is configured to be mated to a barrel of a firearm;

a lower gas bore defined in the gas diversion system body, that is configured to align with a bore defined in the barrel of the firearm when the gas diversion system body is mated to the barrel;

an upper gas bore defined in the gas diversion system body in alignment with the lower gas bore and separated from the lower gas bore by a gap in the gas diversion system body;

a movable platelet disposed within the gap in the gas diversion system body; wherein the movable platelet is pivotable within the gap around a pivot axis pin that is parallel to an axis of the upper and lower gas bores;

the movable platelet defines an internal stop bore, and an interaction between a stop pin extending into the gap in the gas diversion system body and the stop bore limits a pivotable movement of the movable platelet;

the movable platelet further defines at least two recessed catch positions, the at least two recessed catch positions being positioned so that a catch urged by a catch spring can positively engage any one of the at least two recessed catch positions;

the movable platelet further defines at least two gas through-bores, each gas through-bore having a different cross-section, and each gas through-bore being positioned so that it is aligned with the lower gas bore and the upper gas bore when the catch positively engages one of the at least two recessed catch positions;

such that by selectively pivoting the movable platelet within the gap in the gas diversion system body, the gas diversion system defines a passage from the bore defined in the barrel of the firearm to an exit of the upper gas bore that includes a portion having a desired cross-section.

10. The gas diversion system according to claim 9, wherein the pivot axis pin passes through a central portion of the movable platelet.

11. The gas diversion system according to claim 9, wherein the movable platelet has an outline that is generally shaped like an hourglass, or an elongate trapezoid.

12. The gas diversion system according to claim 11, wherein the outline of the movable platelet defines at least two anti-slip notches that are symmetrically disposed with respect to a long axis of the platelet.

13. The gas diversion system according to claim 9, wherein the gas diversion system body defines a cylindrical channel that is configured to receive the barrel of the firearm.

* * * * *